US006163931A

United States Patent [19]

Leifeld

[11] Patent Number: 6,163,931

[45] Date of Patent: Dec. 26, 2000

[54] FEEDING DEVICE FOR ADVANCING FIBER MATERIAL TO A FIBER PROCESSING MACHINE

[75] Inventor: Ferdinand Leifeld, Kempen, Germany

[73] Assignee: Trützschler GmbH & Co. KG, Mönchengladbach, Germany

[21] Appl. No.: 09/451,140

[22] Filed: Nov. 30, 1999

[30] Foreign Application Priority Data

Dec. 2, 1998 [DE] Germany ..... 198 55 571

[51] Int. Cl.[7] ..... D01G 15/40

[52] U.S. Cl. ..... 19/105; 19/200; 19/204

[58] Field of Search ..... 19/65 A, 65 R, 19/97.5, 98, 105, 200, 202, 203, 204, 205

[56] References Cited

U.S. PATENT DOCUMENTS

| | | | |
|---|---|---|---|
| 3,137,040 | 6/1964 | Catling et al. | 19/105 |
| 4,414,710 | 11/1983 | Bolen | 19/105 |
| 4,506,413 | 3/1985 | Leifeld | 19/105 |
| 4,520,531 | 6/1985 | Hergeth | 19/105 |
| 5,014,395 | 5/1991 | Staheli et al. | 19/105 |
| 5,333,358 | 8/1994 | Leifeld | 19/105 |
| 5,479,679 | 1/1996 | Leifeld | 19/105 |
| 5,775,086 | 7/1998 | Stahlecker | 19/105 |

FOREIGN PATENT DOCUMENTS

| | | |
|---|---|---|
| 0 271 115 | 6/1988 | European Pat. Off. . |
| 0 926 274 | 6/1999 | European Pat. Off. . |
| 868 865 | 3/1953 | Germany . |
| 118068 | 11/1961 | Germany . |
| 33 15 909 | 11/1984 | Germany . |
| 34 13 595 | 10/1985 | Germany . |
| 35 34 933 | 4/1987 | Germany . |
| 42 00 394 | 9/1992 | Germany . |
| 44 21 377 | 12/1995 | Germany . |
| 37 33 631 | 4/1998 | Germany . |
| 2 190 109 | 11/1987 | United Kingdom . |

*Primary Examiner*—John J. Calvert
*Assistant Examiner*—Gary L. Welch
*Attorney, Agent, or Firm*—Venable; Gabor J. Kelemen

[57] ABSTRACT

A feeding device for advancing fiber material includes a driven feed roll; a support element immovably held during operation and extending spaced from and generally parallel to the feed roll; and a feed tray assembly composed of a plurality of side-by-side positioned feed tray segments. Each feed tray segment is of a resilient material and has a first portion (end portion) immovably affixed to the support element and a movable, second portion having a surface oriented toward the feed roll and cooperating therewith for advancing the fiber material passing through a nip defined between the feed roll and each feed tray segment. The second portion of each feed tray segment is displaceable toward and away from the feed roll.

23 Claims, 6 Drawing Sheets

Fig. 4
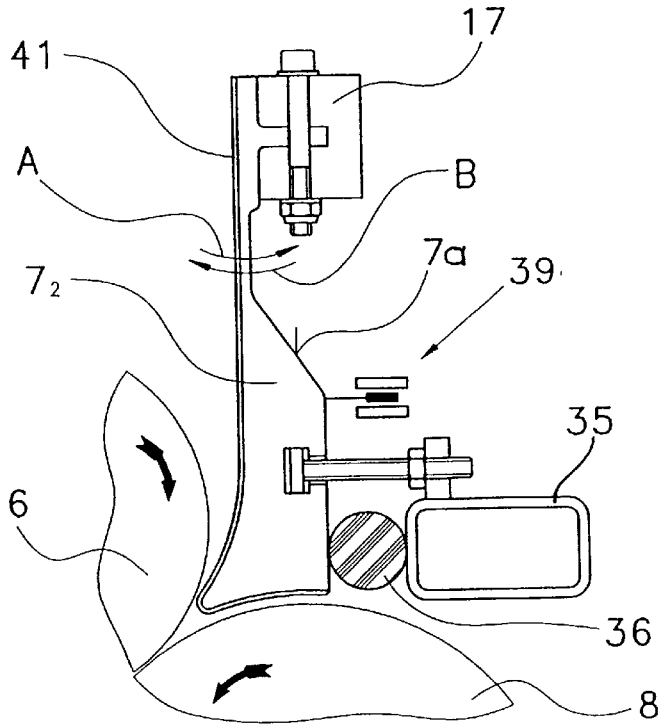
Fig. 5
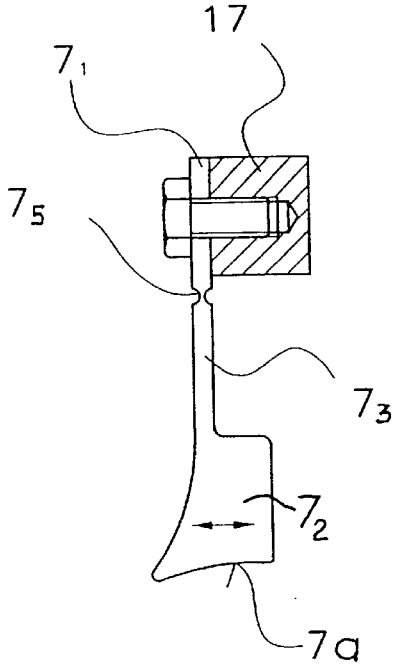
Fig. 6
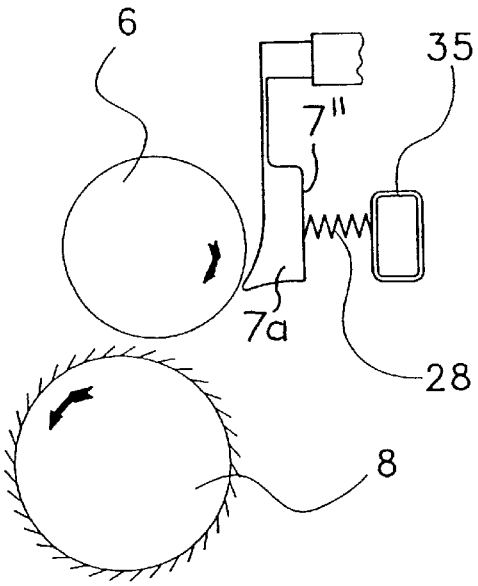
Fig. 7
Fig. 7a
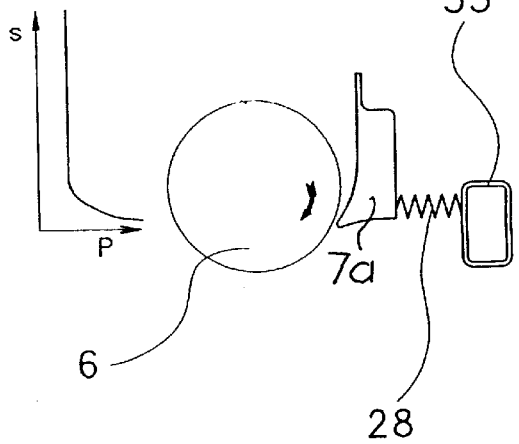

FEEDING DEVICE FOR ADVANCING FIBER MATERIAL TO A FIBER PROCESSING MACHINE

CROSS REFERENCE TO RELATED APPLICATION

This application claims the priority of German Application No. 198 55 571.7 filed Dec. 2, 1998, which is incorporated herein by reference.

BACKGROUND OF THE INVENTION

The invention relates to a feeding device for advancing fiber material to a textile fiber processing machine, such as a carding machine or a fiber cleaner. The fiber feeding device includes a slowly rotating feed roll cooperating with a feed tray assembly formed of individual feed tray segments. Further, a rapidly rotating opening roll is provided which is arranged immediately downstream of the feed tray assembly as viewed in the direction of fiber advance. One end of each feed tray segment is mounted on a fixed supporting element.

German Offenlegungsschrift (application published without examination) No. 34 13 595 discloses a feeder which is disposed upstream of a carding machine. The apparatus has a feed chute in the upper part of which an opening roll is provided and thereabove a feed roll is positioned to which fiber tufts are advanced via a feed tray assembly composed of closely side-by-side arranged individual feed tray segments. Each feed tray segment is pivotal about an axis oriented parallel to the feed roll axis. The feed tray segments are caused by the fiber tufts to undergo excursions which represent the mass of the fiber tufts contacting the respective feed tray segment. The feed tray assembly is positioned at the outlet of a reserve chute which is situated above the feed chute. The shaft to which the feed tray segments are secured projects beyond the two outermost feed tray segments and is situated adjacent the impervious lateral walls of the reserve chute. It is a disadvantage of such an arrangement that the shaft which extends over the entire width of the machine sags and therefore it cannot be used for roller card units having a substantial width of, for example, 3 m or more. Further, deformations may adversely affect an easy rotatability of the feed tray segments. Also, the distance between the feed tray segments, on the one hand, and the feed roll, on the other hand, disadvantageously changes and further, the pressing forces are not uniform between the feed tray segments, on the one hand, and the feed roll, on the other hand. Also, the clearance between adjoining feed tray segments may change or be distorted which may lead to operational disturbances. It is yet another drawback of the conventional arrangements that an adaptation of the feeding device to various types of fiber material, particularly various fiber lengths, is not feasible.

SUMMARY OF THE INVENTION

It is an object of the invention to provide an improved feeding device of the above-outlined type from which the discussed disadvantages are eliminated and which, in particular, is structurally simple and operationally reliable and makes possible a precise clamping of the fiber material between the feed tray segments and the feed roll.

This object and others to become apparent as the specification progresses, are accomplished by the invention, according to which, briefly stated, the feeding device for advancing fiber material includes a driven feed roll; a support member immovably held during operation and extending spaced from and generally parallel to the feed roll; and a feed tray assembly composed of a plurality of side-by-side positioned feed tray segments. Each feed tray segment is of a resilient material and has a first portion (end portion) immovably affixed to the support member and a movable, second portion having a surface oriented toward the feed roll and cooperating therewith for advancing the fiber material passing through a nip defined between the feed roll and each feed tray segment. The second portion of each feed tray segment is displaceable toward and away from the feed roll.

By affixing, according to the invention, one end of the feed tray segments to a common, stable and immovable supporting element, a linear orientation of the feed tray segments is ensured in a simple manner, and between the feed tray segments and the feed roll in all regions the same pressing forces related to the unit length of the feed roll is maintained. At the same time undesired deformations between adjoining feed tray segments is avoided, whereby the operational reliability and uniformity of the advanced fiber material are improved. It is a particular advantage of the invention that stationary, immovable machine components, including, for example, the machine frame, the machine stand, walls and connecting elements may be used to support the feed tray segments. The supporting element which is, for, example, affixed to the machine frame is compact and rigid. Thus, by firmly affixing the feed tray segments at an end thereof which is immovable, the feed tray segments are integrated into the machine structure.

BRIEF DESCRIPTION OF THE DRAWINGS

FIG. 4 is a side elevational view of a feed tray segment according to the invention, associated with an inductive path sensor.

FIG. 5 is a side elevational view of a feed tray segment and its attachment to a carrier.

FIG. 6 is a schematic side elevational view showing a spring support for a feed tray segment according to the invention.

FIG. 7 is a schematic side elevational view, similar to FIG. 6, showing a pressing spring in alignment with the location of the maximum pressure forces between a feed tray segment and a feed roll.

FIG. 7*a* is a graph illustrating the pressure/displacement curve.

DESCRIPTION OF THE PREFERRED EMBODIMENTS

Figure 1:
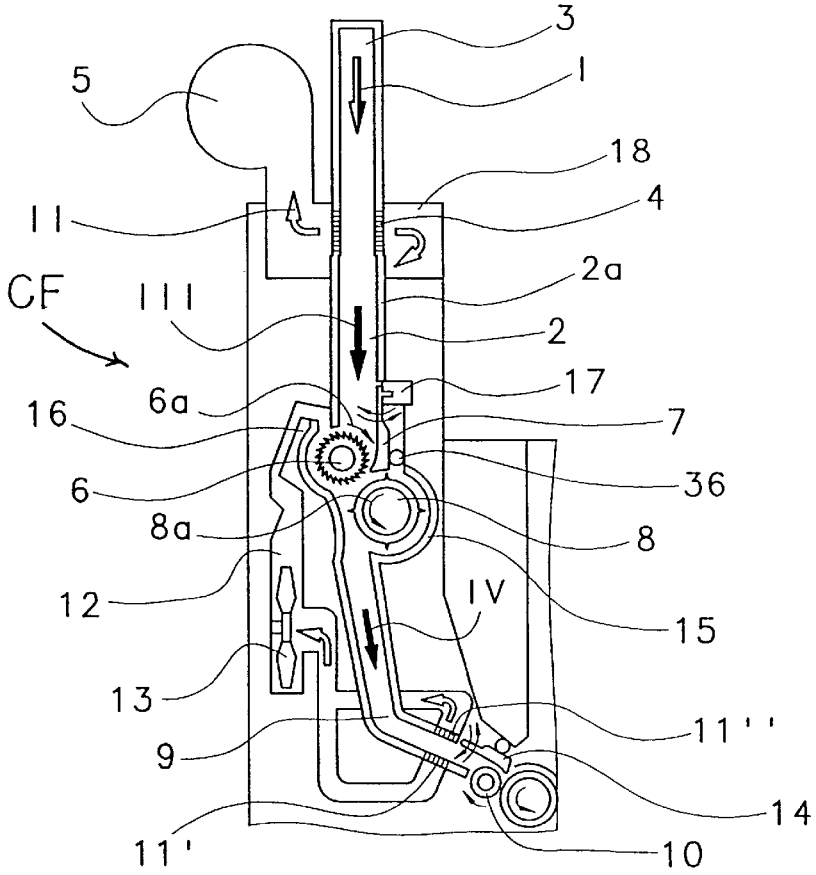
FIG. 1 is a schematic side elevational view of a card feeder incorporating the invention.

Turning to FIG. 1, upstream of a non-illustrated carding machine a card feeder CF is disposed which may be, for example, a DIRECTFEED model manufactured by Tr ützschler GmbH & Co. KG, Mönchengladbach, Germany. The card feeder CF is provided with a vertically oriented reserve chute 2 charged from the top with a mixture I composed of air and finely opened fiber material. Such a feed may be effected by a condenser via a supply and distributor duct 3. In the upper region of the reserve chute 2 air outlet openings 4 are provided through which the transporting air II passes into a suction device 5 after being separated from the fiber tufts III. The lower end of the reserve chute 2 is closed off by a feed roll 6 which cooperates with a feed tray assembly 7 composed of a plurality of serially arranged feed tray segments 7*a,* as shown, for example, in FIG. 14*b*. The slowly rotating feed roll 6 draws the fiber material III from the reserve chute 2 and advances it to a rapidly rotating opening roll 8 which may be provided with pins or may have a sawtooth clothing. The feed roll rotates clockwise as indicated by the arrow 6*a* whereas the opening roll 8 rotates counterclockwise so that oppositely oriented rotations of the two rolls are obtained.

One part of the circumference of the opening roll 8 projects into a feed chute 9 which adjoins the reserve chute 2. The opening roll 8, as it rotates in the direction of the arrow 8*a,* advances the fiber material IV to the feed chute 9 which, at its lower end, has a rotary pull-off roll 10. The pull-off roll 10, in turn, advances the fiber material (fiber lap) to the non-illustrated carding machine.

The walls of the feed chute 9 are provided in the lower part thereof with air outlet openings 11', 11". The upper portion of the feed chute 9 is in communication with a space 12 with which the pressure outlet of a fan 13 communicates. By means of the rotating feed roll 6 and the opening roll 8 a predetermined quantity of fiber material III is continuously supplied to the feed chute 9 and an equal quantity of fiber material (fiber lap) is withdrawn by the withdrawing roll 10. The latter cooperates with a feed tray assembly 14 composed of a plurality of serially arranged feed tray segments. The feeding (fiber lap withdrawing) arrangement 10, 14 introduces the fiber lap to the non-illustrated carding machine. To uniformly densify and maintain constant the fiber quantities, in the feed chute 9 the fiber material is exposed to an air stream from the space 12, driven by the fan 13. The air is drawn into the fan 13 and driven through the fiber mass dwelling in the feed chute 9 and, thereafter, the air exits through the air outlet openings 11', 11" at the lower end portion of the feed chute 9.

The opening roll 8 is surrounded by a wall of a housing 15, while the feed roll 6 is surrounded by a wall of a housing 16; the walls are adapted to the circular configuration of the rolls 6 and 8. As viewed in the rotary direction 8*a* of the opening roll 8, the housing 15 is interrupted by a separating opening for the fiber material III. The separating opening is adjoined by the wall face which reaches to the feed roll 6. The feed tray assembly 7 is arranged at the lower end of the wall face situated opposite the feed roll 6. The edge of the feed tray assembly 7 is oriented in the direction of rotation 8*a* of the opening roll 8. The plane which contains the rotary axis of the feed roll 6 and the opening roll 8 is arranged at an oblique angle to the vertical plane containing the rotary axis of the opening roll 8 and is inclined in the rotary direction of the opening roll 8. The wall face 2*a* of the reserve chute 2 forms a stationary support element 17 of the machine frame 18. The feed tray segments 7*a* of the feed tray assembly (feed tray bodies)$7_2$ are in the region of one of their ends $7_1$ mounted on the stationary support element 17 whereas their respective other ends (feed tray bodies) $7_2$ are freely movable. The ends $7_1$ are immovably secured to the support element 17 of the machine frame 18. The feed tray assembly 7 is made of an elastic material, whereby the free ends $7_2$ of the individual feed tray elements 7*a* are freely movable in the direction of the arrows A and B.

Figure 2:
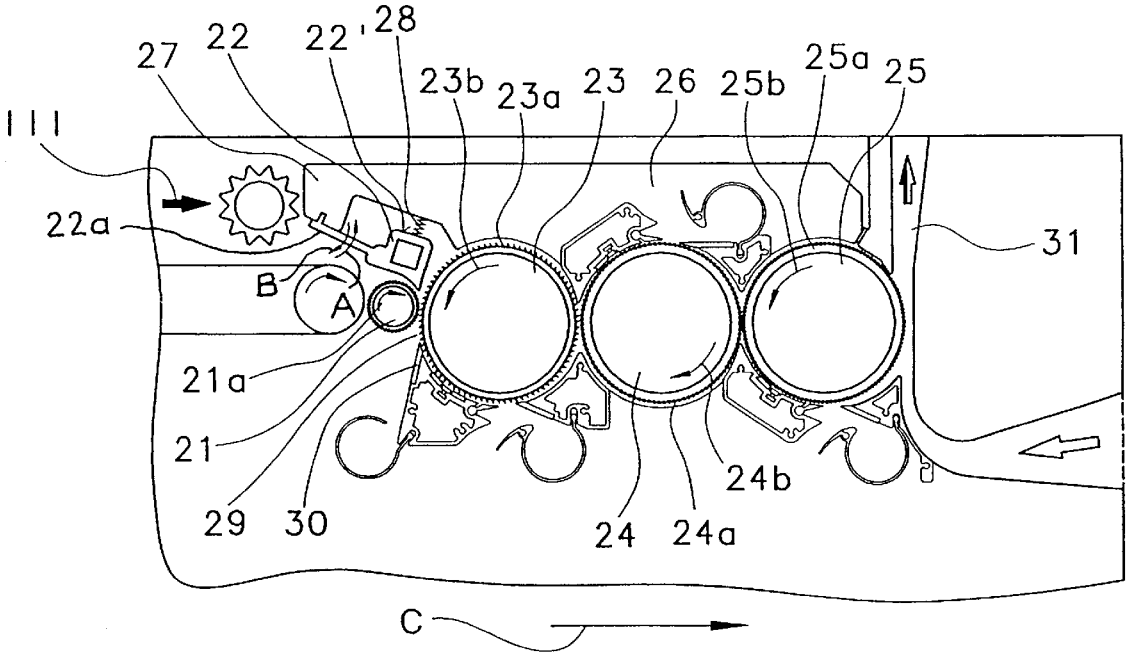
FIG. 2 is a schematic side elevational view of a fiber cleaner incorporating the invention.

FIG. 2 illustrates a fiber cleaning device which is accommodated in a closed housing 26 and which may be a CVT cleaner manufactured by Trützschler GmbH & Co. KG. The fiber material to be cleaned, particularly cotton, is supplied to the cleaner in fiber tuft form. This is effected, for example, by a non-illustrated feed chute, by a feed belt or the like. The fiber lap is advanced to a rapidly rotating pin roll 23 (having pins 23*a* and a diameter, for example, of 250 mm) by a withdrawing roll (feed roll) 21 and a feed tray assembly 22 cooperating therewith to effect clamping of the fiber lap. The pin roll 23 is rotatably supported in the housing and rotates in the direction of the arrow 23*b*. The pin roll 23 is followed by clothed rolls 24 and 25 rotating in respective directions 24*b* and 25*b*. The clothed roll 24 is provided with a sawtooth clothing and has a diameter of, for example, 250 mm. The pin roll 23 has a circumferential speed of, for example, 15 m/sec while the roll 24 has a circumferential of, for example 20 m/sec. The circumferential speed of the roll 25 is greater than that of the roll 24; the diameter of the roll 24 is, for example, 250 mm. The pin roll 23 is closely surrounded by the housing 26 and cooperates with a separating opening 29 for the exit of fiber impurities. The size of the opening 29 may be adapted to the degree of dirt of the cotton. The separating opening 29 is bordered by a severing edge, for example, a mote knife.

The feeding device is formed of the slowly rotating feed roll 21 which rotates in the direction of the arrow 21*a* and the feed tray assembly 22 which is disposed above the feed roll 21. The feed tray assembly 22 is, at one end 22*a,* supported on an immovable support element 27 of the stationary housing 26. A spring 28 engages the outer upper face 22' of the feed tray assembly 22 for resiliently urging the feed tray assembly 22 toward the feed roll 21 which is rotatably but radially immovably supported. The feed tray 22 is composed of a plurality of feed tray elements whose free ends are movable in the direction of the arrows A and B. The feed tray assembly 22 is structured similarly to the earlier described feed tray assembly 7.

The above-described cleaner operates as follows:

The fiber lap composed of fiber tufts is advanced by the feed roll 21 in cooperation with the feed tray assembly 22 under the clamping effect of the pin roll 23 which combs the fiber material III and entrains fiber clumps on its pins. As the circumferential surface portions of the roll 23 pass by the separating opening 29 and the mote knife 30, short fibers and coarse impurities are thrown out by centrifugal force from the fiber material through the separating opening 29 as a function of the circumferential speed and curvature of the roll 23 as well as a function of the size of the separating opening 29 adapted to the first separating stage. The thus pre-cleaned fiber material is taken over by the clothing points 24*a* of the clothed roll 24 from the first roll (pin roll) 23, as a result of which the fiber material is further opened. Thereafter, the fiber material is taken over by the clothing points 25*a* of the roll 25 which is situated downstream of the roll 24 as viewed in the working direction C and as a result, the fiber material is still further opened and eventually is transported to a non-illustrated further processing machine by a pneumatic removal apparatus 31.

The apparatus illustrated in FIG. 3*a* is a feeder for a roller card unit and corresponds essentially to the card feeder of FIG. 1. While the working width in a card feeder is approximately 1–1.5 m, this dimension is 3 m or more in a roller card feeder. The feeder includes a hollow, cross-sectionally rectangular carrier beam 35 which may be made of structural steel. The carrier beam 35 is stable and resists bending and has a length of about 5 m. Between the carrier beam 35 and the feed roll 6 a feed tray assembly 7 is provided which is composed, as described before, of a plurality of feed tray segments 7*a* secured to a support element 17. The feed tray segments are resiliently supported by a rubber spring rod 36 which is counter supported on the throughgoing, fixedly held carrier beam (counter support 35). Further, for each feed tray segment 7*a* an abutment element 37 is provided which limits the excursion of the feed tray elements 7*a* in the direction A, B. The feed tray assembly is an integral, one-piece component composed of a throughgoing securing region $\mathbf{7}_1$ extending over the width of the machine and of the individual feed tray segments 7*a*. Each feed tray segment 7*a* is formed of a feed tray body $\mathbf{7}_2$ and a narrow connecting region $\mathbf{7}_3$ which functions as an elastic connection and is structured essentially as a leaf spring. The connecting region $\mathbf{7}_3$ couples the feed tray body $\mathbf{7}_2$ with the securing region $\mathbf{7}_1$. The securing region $\mathbf{7}_1$ has a perpendicularly oriented projection $\mathbf{7}_4$ which extends into a recess 17' of the support element 17 and is immobilized by a securing screw-and-nut assembly 38, 39. The support element 17 with the feed tray segments 7*a*, on the one hand, and the carrier beam 35, on the other hand, are secured independently from one another on the rigid lateral walls of the machine. The support element 17 together with the feed tray segments 7*a* and the carrier beam 35 may be adjustable when not in operation so that for different types of fiber material the distance and thus the intake gap between the feed tray segments 7*a* and the feed roll 6 may be suitably varied. It is, however, in the alternative, also feasible to provide a stationary and immovable securement of the support element 17 and the carrier beam 35.

Figure 19:
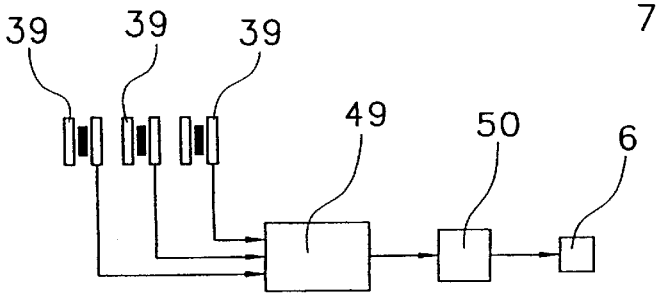
FIG. 19 is a block diagram of an electronic control and regulating device to which the inductive path sensors associated with the respective feed tray segments as shown in FIG. 4 as well as an rpm-regulated drive motor for the feed roll are connected.

Turning to FIG. 4, with the feed tray body $\mathbf{7}_2$ of each feed tray segment 7*a* an inductive path sensor 39 is associated which is composed of a plunger armature and a plunger coil and is connected to an electronic control and regulating device as shown in FIG. 19. In this manner, upon oscillation of the feed tray segments 7*a* electric pulses are generated which represent the tray segment excursions in response to thickness variations of the fibers which pass through the intake gap between the feed tray assembly 7 and the feed roll 6. The feed tray segments 7*a* are provided with a wear-resistance layer, for example, a high grade steel plating 41 on the side which contacts the fiber material.

According to FIG. 5, each feed tray segment 7*a* has a connecting part $\mathbf{7}_3$ which couples the tray segment body $\mathbf{7}_2$ with the support element 17 to which it is secured at $\mathbf{7}_1$. The resiliency of each feed tray segment 7*a* is ensured by the weakening notches $\mathbf{7}_5$ provided in the connecting part $\mathbf{7}_3$ in the vicinity of its securement $\mathbf{7}_1$.

Turning to FIG. 6, the required clamping forces for holding the fiber material against the opening forces of the after-connected opening roll 8 are applied—in addition to the inherent resiliency of the feed tray segments—by a respective further spring 28 (such as a compression spring) which is positioned between a rearward face 7" of each feed tray segment 7*a* and the carrier beam 35. The inherent resiliency of the feed tray elements is obtained by the particular configuration of their elastic material such as steel, aluminum, synthetic material or wood.

In FIG. 7, the pressing spring 28 of each feed tray element 7*a* is positioned as close as possible to the maximum pressure location in the pressing zone for the fiber material. The graph of FIG. 7*a* shows the pressure/displacement (P/S) curve.

Figure 8:
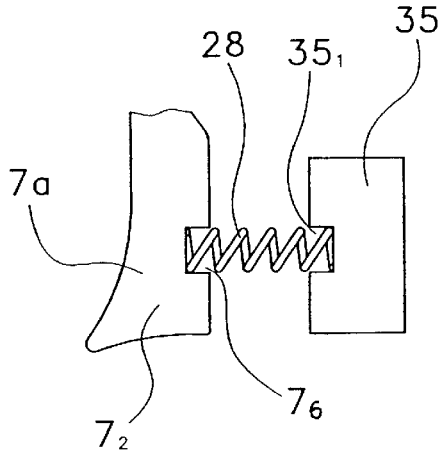
FIG. 8 is a schematic side elevational view showing the accommodation of a pressing spring in the feed tray segment and a spring support.

As shown in FIG. 8, in the feed tray body $\mathbf{7}_2$ of the individual feed tray elements 7*a* and in the carrier beam 35 respective recesses $^{7}{}_{6}$ and $\mathbf{35}_1$ are provided for receiving the respective ends of elastic elements, such as springs 28.

Figure 9:
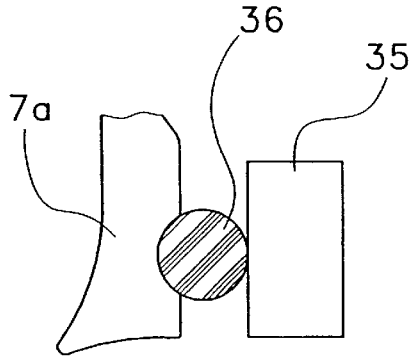
FIG. 9 is a schematic side elevational view showing a feed tray segment and an elastomer spring rod disposed between the feed tray segment and a counter support.

According to FIG. 9, the elastomer spring, for example, the rubber spring rod 36 which extends over the width of the machine, is glued to the feed tray segments 7*a*.

Figure 10:
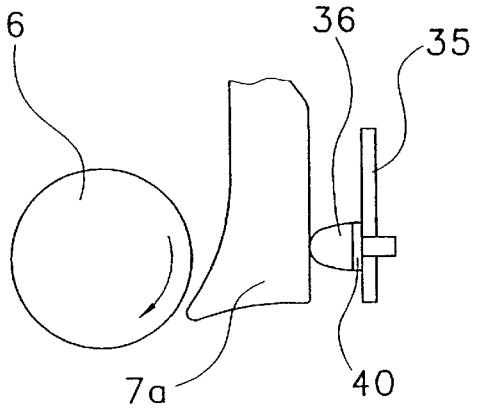
FIG. 10 is a schematic side elevational view showing a feed tray segment and a metal/rubber buffer disposed between the feed tray segment and a counter support.

In FIG. 10, as an elastic element a composite component is used which is formed of a rubber spring 36 bonded to a metal element 40 which, in turn, is attached to the carrier beam 35.

Figure 11:
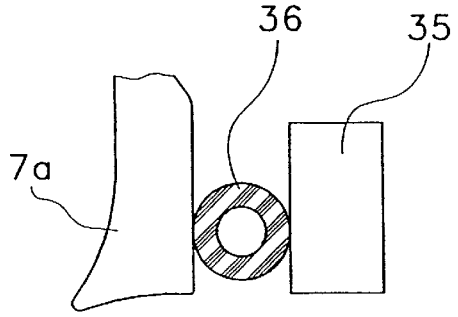
FIG. 11 is a view similar to FIG. 9, showing a hollow elastomer spring rod.

As shown in FIG. 11, the elastic element may be a hollow rubber bar 36.

Figure 12:
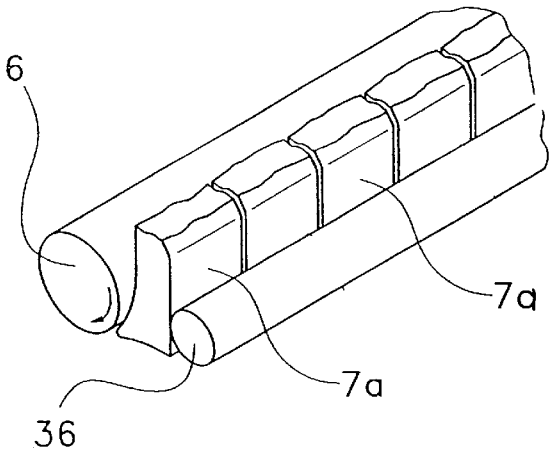
FIG. 12 is a schematic perspective view showing part of a feed tray assembly and a single rubber bar biasing the feed tray segments.

FIG. 12 shows how all the feed tray elements 7*a* are biased by a round rubber bar which extends over the entire width of the machine.

Figure 13:
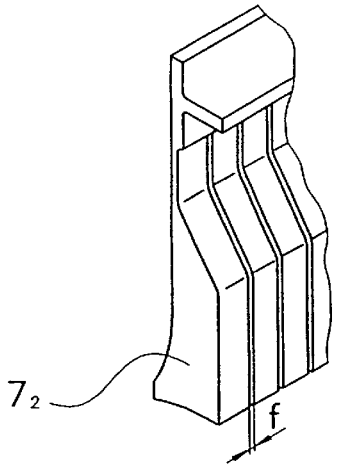
FIG. 13 is a schematic perspective view of a fragment of a single-piece feed tray assembly.

FIG. 13 illustrates that the entire feed tray assembly 7 is made as a one-piece, integral component. The yielding properties of each feed tray segment 7*a* are ensured by parallel spaced cuts which have a width f and between which the feed tray segments are defined.

Figure 3:
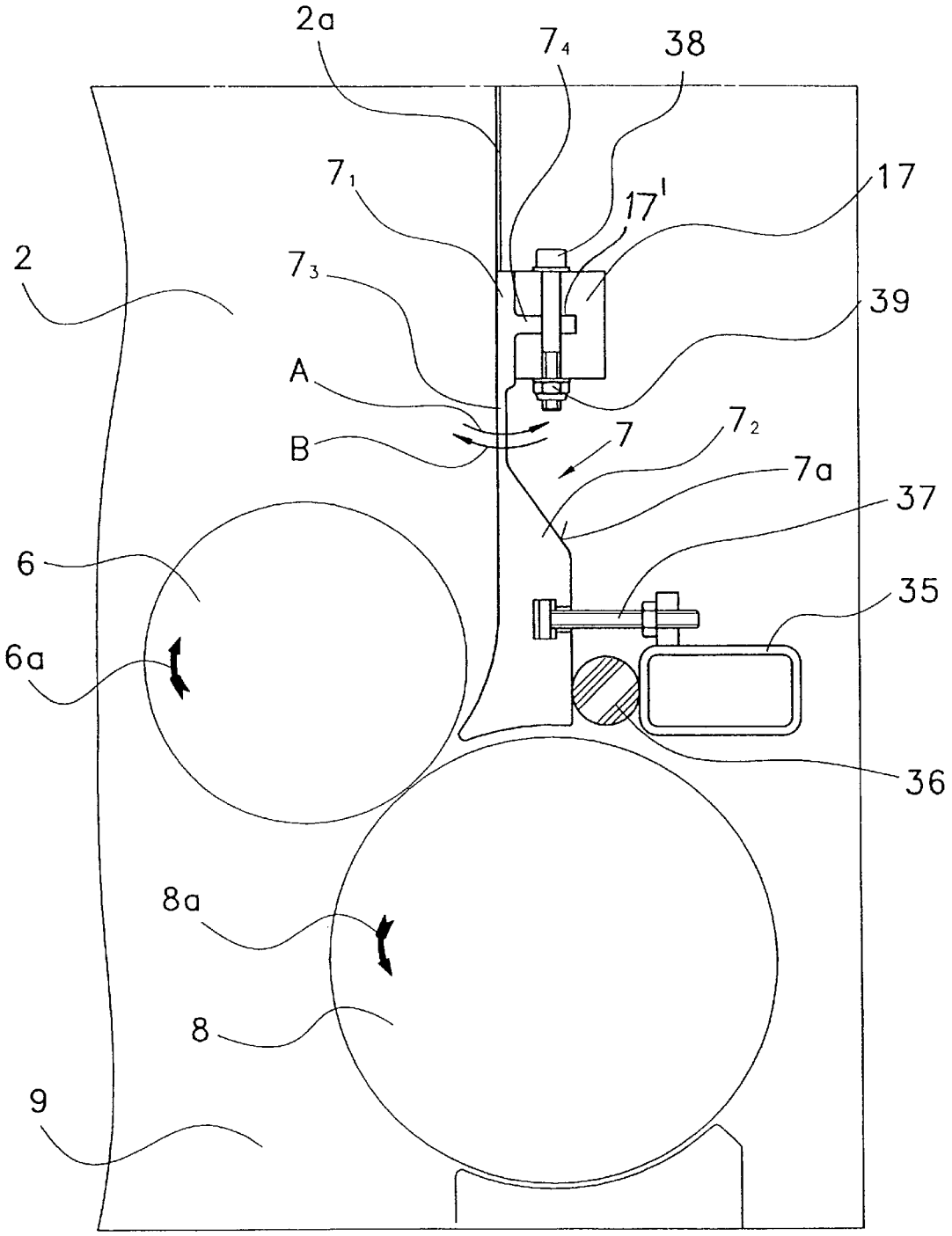
FIG. 3 is a schematic side elevational view of a preferred embodiment of the invention installed in the reserve chute of a roller card feeder.
Figure 14A:
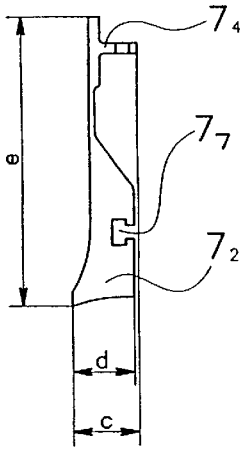
FIG. 14*a* is a schematic side elevational view of a feed tray assembly according to the invention.
Figure 14B:
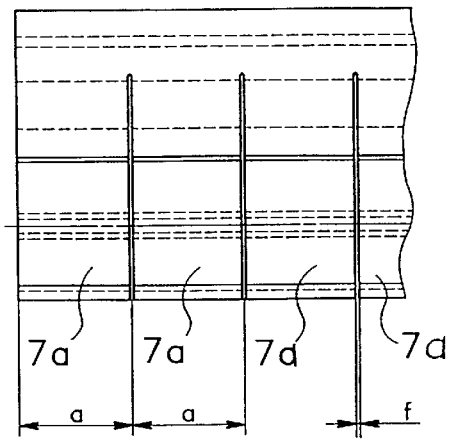
FIG. 14*b* is a schematic front elevational view of the construction shown in FIG. 14*a*.
Figure 20B:
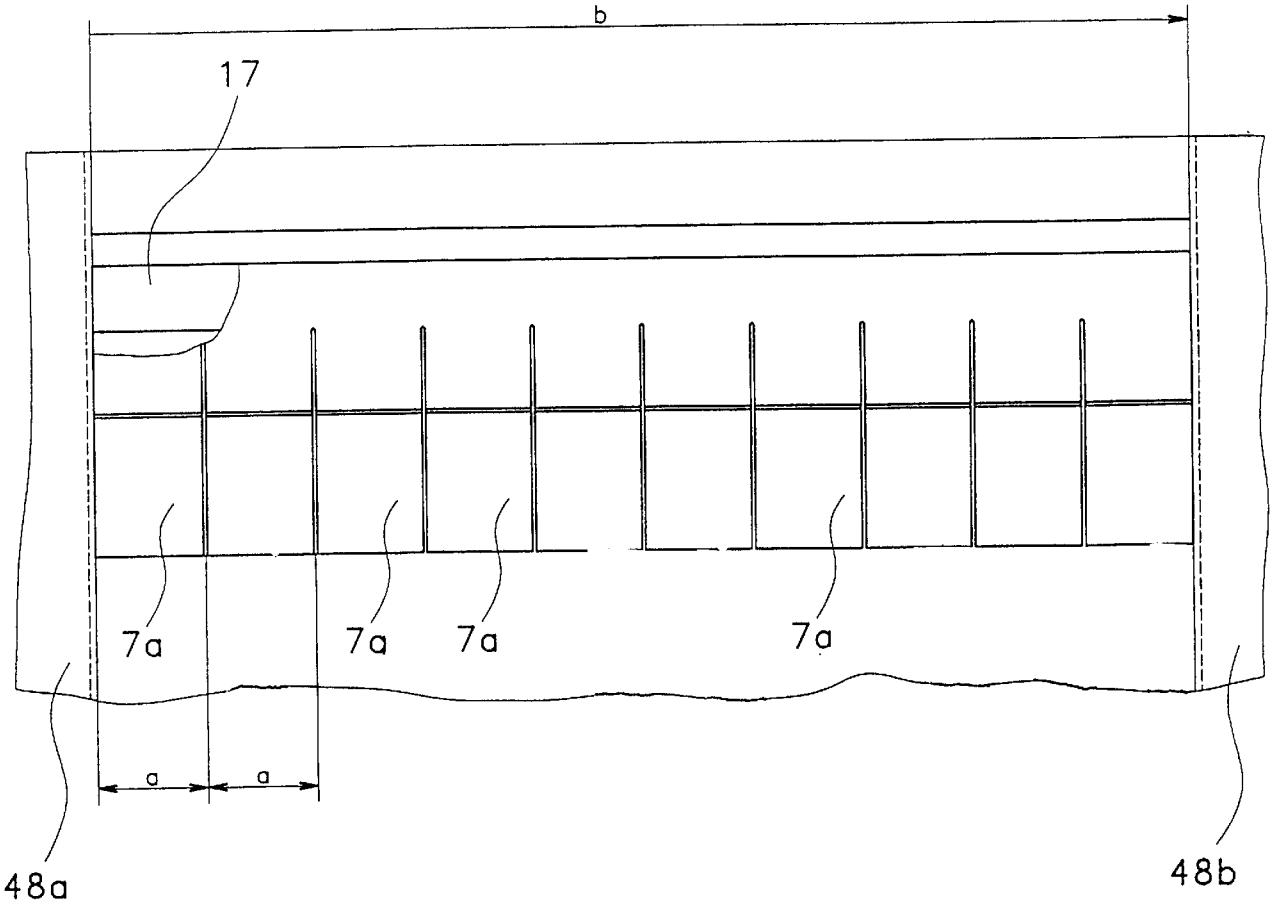
FIG. 20*b* is a front elevational view of the construction shown in FIG. 20*a*.
Figure 20A:
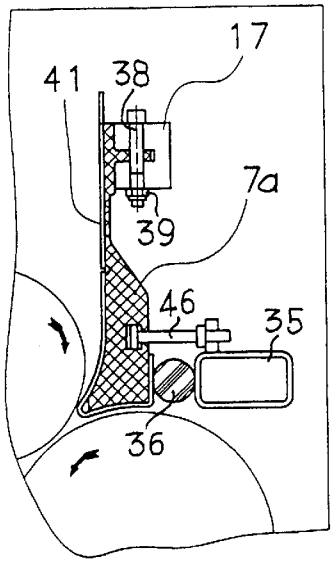
FIG. 20*a* is a side elevational view of a feed tray assembly partially in section, according to a further embodiment of the invention.

Turning to FIGS. 14*a* and 20*a*, the thickness (depth) of the feed tray body $\mathbf{7}_2$ is designated at d and may be, for example, 40–80 mm whereas its height is designated at e and may be, for example 200–300 mm. The overall dimension in the working direction is designated at c. A T-shaped recess $\mathbf{7}_7$ is provided in the feed tray body $\mathbf{7}_2$ to receive the end of an abutment member 46 held on the carrier beam 35. The abutment member 46 limits the excursions of the feed tray segments 7*a* in both directions. The projection $\mathbf{7}_4$ has a throughgoing bore to receive the screw-and-nut assembly 38, 39 as also shown in FIG. 3. The width of each feed tray segment 7*a* is designated at a in FIG. 14*b* and may amount to approximately 80–120 mm. The feed tray segments 7*a* are made of an elastic material whose surface oriented toward the fiber material is provided with a respective high grade steel plating 41.

Figure 15:
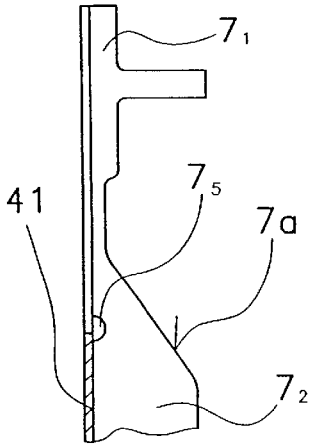
FIG. 15 is a fragmentary side elevational view of a feed tray segment plated with high grade steel.

Turning to FIG. 15, after plating, for example, with a high grade steel plate 41, a weakening notch $7_5$ is provided to increase the resiliency of the feed tray segments 7*a* relative to their common support element 17. The steel plating is divided over the entire working width of the feed tray assembly 7 by the separating cuts and the plating sheet material is removed from the zones $7_1$ and $7_3$.

Figure 16:
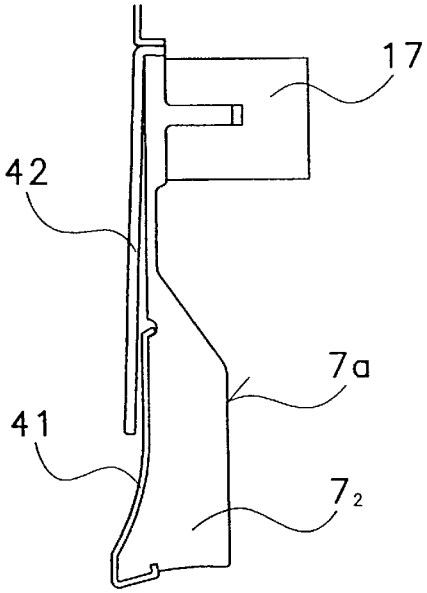
FIG. 16 is a side elevational view of a feed tray segment including a sheet metal covering.

In accordance with FIG. 16, in addition to the steel plating 41 for the individual segments 7*a,* over the entire width of the machine a sheet metal cover member 42 is installed which extends from the securing zone at the support element 17 down to the upper part of the segment body $7_2$ of the feed tray segments 7*a*. The cover plate 42 may also serve as an abutment.

Figure 17:
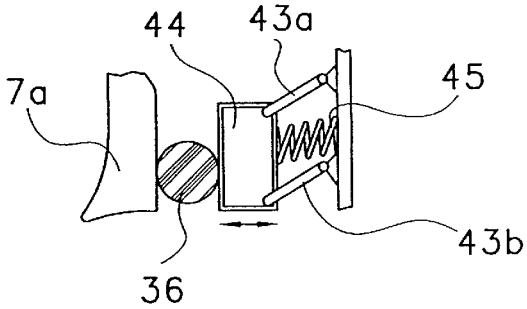
FIG. 17 is a fragmentary side elevational view of a feed tray segment showing a spring biased support for a rubber pressing spring.

As shown in FIG. 17, a holding element 44 is provided which counter supports the spring rod 36 and which is movable by two links 43*a* and 43*b* connected with the machine frame. A spring 45 urges the holding element against the spring rod 36.

Figure 18:
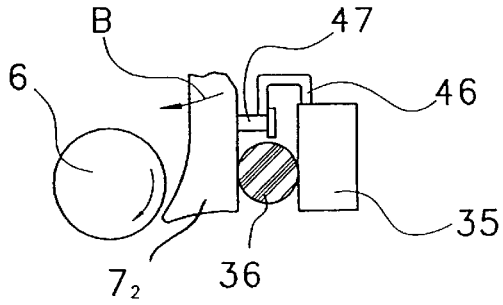
FIG. 18 is a fragmentary schematic side elevational view of a feed tray segment and an abutment limiting the excursion of the feed tray segment.

According to FIG. 18, on the carrier beam 35 an abutting element 46 is provided which is connected with a projection 47 (such as a screw or the like) mounted on the tray segment body $7_2$ in such a manner that the excursion in the direction B is limited. In this manner, a contacting between the tray segment body $7_2$ and the feed roll 6 is prevented. The length of the projection 47 may be adjusted and thus the gap width may be set.

Turning to FIG. 19, the inductive path sensors 39 are connected with an electronic control and regulating device 49, for example, a microcomputer to which there are also connected an rpm-regulated motor 50 for the feed roll 6. The setting signals emitted by the control and regulating device 49 may be also used for a plurality of setting members distributed along the width b of the machine, for example, for setting the depth of a chute.

According to FIG. 20*b,* the elongated support element 17 is, at its frontal face, mounted on the inner walls of the stationary machine walls 48*a* and 48*b*. The inner machine width b is approximately 1,000–1,400 mm.

It will be understood that the above description of the present invention is susceptible to various modifications, changes and adaptations, and the same are intended to be comprehended within the meaning and range of equivalents of the appended claims.

What is claimed is:

1. A feeding device for advancing fiber material comprising (a) a driven feed roll having a rotary axis and an axial length;

(b) a support element being immovably held during operation and extending spaced from and generally parallel to said feed roll; and (c) a feed tray assembly composed of a plurality of side-by-side positioned feed tray segments; each feed tray segment being of a resilient material and having (1) a first portion immovably affixed to said support element; said first portion constituting an immovable end portion; and (2) a movable second portion having a surface oriented toward said feed roll and cooperating therewith for advancing the fiber material passing through a nip defined between said feed roll and each said feed tray segment; said second portion being displaceable toward and away from said feed roll.

2. The device as defined in claim 1, wherein each said feed tray segment is a one-piece component.

3. The device as defined in claim 1, wherein said support element is an elongated component.

4. The device as defined in claim 1, wherein said support element is rigid to bending.

5. The device as defined in claim 1, further comprising abutment members cooperating with each said feed tray segment for limiting displacement paths thereof.

6. The device as defined in claim 1, wherein each said feed tray segment has a third portion connecting said movable second portion with said immovable first portion and acting as a leaf spring for allowing resilient displacements of said second portion relative to said first portion.

7. The device as defined in claim 1, further comprising clamping means for tightening said first portions to said support element.

8. The device as defined in claim 1, wherein said surface of said movable portion of each said feed tray segments is provided with a steel plating.

9. The device as defined in claim 8, further comprising a sheet metal cover member extending continuously along said feed tray assembly; said sheet metal cover facing said feed tray segments and extending to said steel plating.

10. The device as defined in claim 1, further comprising a plurality of displacement sensors cooperating with respective said feed tray segments for emitting signals representing excursions of the respective feed tray segments.

11. The device as defined in claim 10, further comprising a motor for driving said feed roll and a control and regulating device connected to said sensors and said motor for regulating the rpm of said motor as a function of said excursions.

12. The device as defined in claim 1, wherein said feed tray assembly is a single-piece component; and further wherein the first portions constitute a continuous component extending along and being affixed to said support element and said second portions are separated from one another by a clearance and are movable toward and away from said feed roll independently from one another.

13. The device as defined in claim 12, wherein each said feed tray segment has a third portion connecting said movable second portion with said immovable first portion and acting as a leaf spring for allowing resilient displacements of said second portion relative to said first portion.

14. The device as defined in claim 1, in combination with a fiber processing apparatus receiving directly the fiber material as it emerges from between said feed roll and said feed tray assembly.

15. The device as defined in claim 14, wherein said fiber processing apparatus comprises a feed chute.

16. The device as defined in claim 14, wherein said fiber processing apparatus is a fiber cleaner.

17. The device as defined in claim 1, further comprising resilient means for contacting a surface portion of each said feed tray segment to urge each said feed tray element toward said feed roll.

18. The device as defined in claim 17, wherein said resilient means includes a continuous rubber-elastic bar extending along said feed tray segments.

19. The device as defined in claim 17, wherein said resilient means comprises a first spring; further comprising a driven opening roll disposed adjacent said feed roll for receiving fiber material emerging from between said feed tray assembly and said feed roll; said resilient means comprises a second spring for aiding said first spring in clamping the fiber material against pulling forces exerted by said opening roll.

20. The device as defined in claim 17, further comprising a counter support extending along said feed tray assembly for counter supporting said resilient means.

21. The device as defined in claim 20, wherein said resilient means includes individual springs; each said spring contacting a respective said feed tray segment and said counter support.

22. The device as defined in claim 20, further comprising abutment members cooperating with each said feed tray segment for limiting displacement paths thereof; said abutment members being mounted on said counter support.

23. The device as defined in claim 22, wherein said abutment members are arranged for limiting an excursion path of said feed tray segments toward said feed roll.

* * * * *